US007296831B2

(12) United States Patent
Generowicz et al.

(10) Patent No.: US 7,296,831 B2
(45) Date of Patent: Nov. 20, 2007

(54) WINDOW LOCK KEEPER

(76) Inventors: Paul Generowicz, P.O. Box 940133, Rockaway Park, NY (US) 11694; Luke Liang, 500 Metuchen Rd. S., Plainfield, NJ (US) 07080

( * ) Notice: Subject to any disclaimer, the term of this patent is extended or adjusted under 35 U.S.C. 154(b) by 136 days.

(21) Appl. No.: 10/932,883

(22) Filed: Sep. 2, 2004

(65) Prior Publication Data

US 2005/0077735 A1 Apr. 14, 2005

Related U.S. Application Data

(60) Provisional application No. 60/499,599, filed on Sep. 3, 2003.

(51) Int. Cl.
*E05C 3/14* (2006.01)

(52) U.S. Cl. ..... 292/242; 292/DIG. 47

(58) Field of Classification Search ..... 292/242, 292/65, 140, 197, 340, 257, 240–241, DIG. 47, 292/DIG. 35, DIG. 20; 70/89–90, 441, 432, 70/DIG. 59; 116/294–295, 303, 16, 85–86, 116/100

See application file for complete search history.

(56) References Cited

U.S. PATENT DOCUMENTS 369,885 A * 9/1887 Shaw ..... 292/65
986,555 A * 3/1911 Donat ..... 70/90
1,617,813 A * 2/1927 Judge ..... 292/150
1,651,048 A * 11/1927 Talbot ..... 292/336
2,480,016 A * 8/1949 Granberg ..... 292/336
4,050,724 A * 9/1977 Nakanishi ..... 292/241
4,061,370 A * 12/1977 Hauber ..... 292/175
4,063,766 A * 12/1977 Granberg ..... 292/336
5,437,173 A * 8/1995 Spinar ..... 70/89
6,848,728 B2 * 2/2005 Rotondi et al. ..... 292/336
2004/0026932 A1 * 2/2004 Coleman et al. ..... 292/241
2006/0087130 A1 * 4/2006 Liang ..... 292/242

* cited by examiner

*Primary Examiner*—Brian E. Glessner
*Assistant Examiner*—Kristina R Gluchowski
(74) *Attorney, Agent, or Firm*—Thomas A. O'Rourke; Bodner & O'Rourke, LLP

(57) ABSTRACT

An improved sash lock and keeper for a sash window assembly is disclosed. The sash window includes an upper sash window and a lower sash window. Each of the sashes is mounted within opposed guide rails which permit at least one of the sashes to travel slidably therein. The sash lock includes an actuator for engaging a keeper. The keeper is mounted on a style of one of the sash windows. The actuator has an actuator arm and a cam. The cam has a cam surface for engaging a keeper surface. When the cam surface engages the keeper surface thereby locking the two sashes, a flag extends from the keeper to signal that the actuator is in locking engagement with the keeper.

15 Claims, 6 Drawing Sheets

FIG. 8
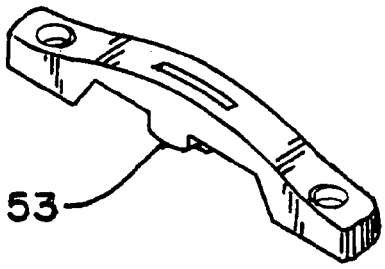
FIG. 9
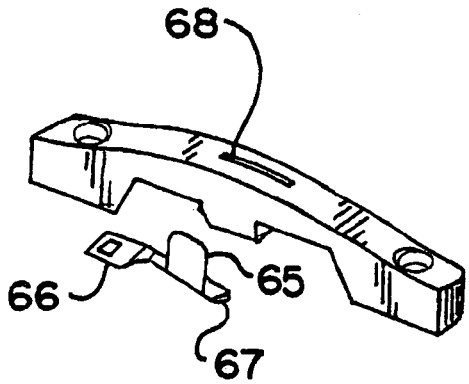
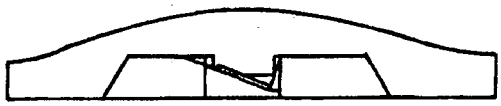
FIG. 10A
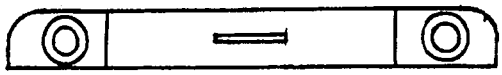
FIG. 10B

FIG. 11
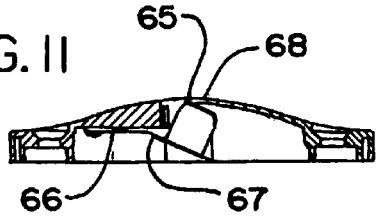
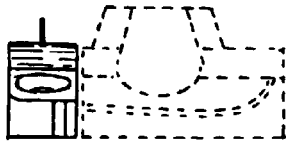
FIG. 13
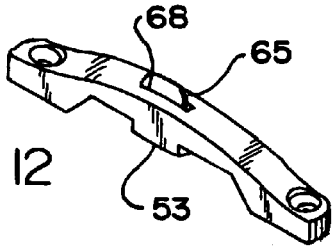
FIG. 12
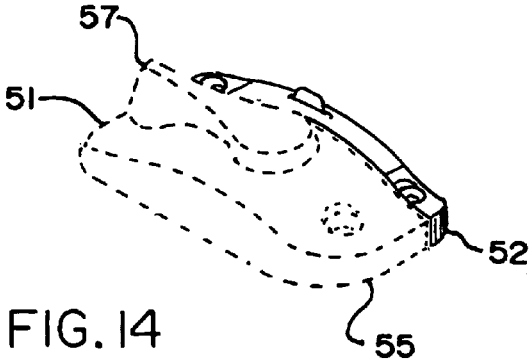
FIG. 14
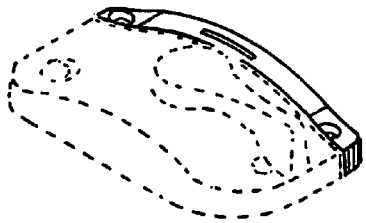
FIG. 15

FIG. 16A
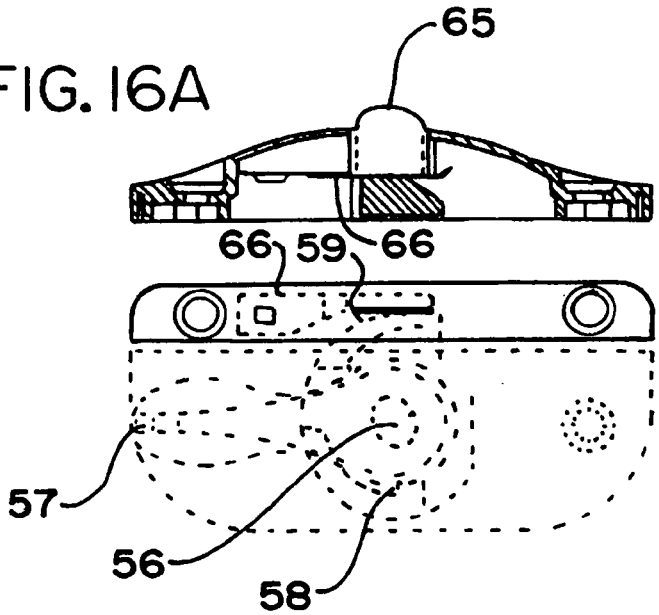
FIG. 16B
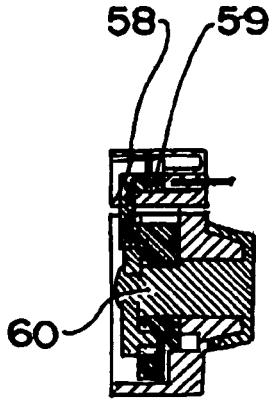
FIG. 16C
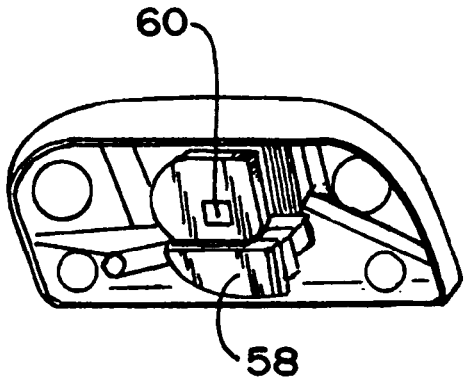
FIG. 17

WINDOW LOCK KEEPER

This is a conversion of Provisional Patent Application Ser. No. 60/499,599, filed Sep. 3, 2003.

FIELD OF THE INVENTION

The present invention is directed to window or sash locks and more particularly improved keepers used with such sash lock assemblies.

BACKGROUND OF THE INVENTION

One of the more-common window types is the double hung window. Double hung windows are generally defined as two individual glass panels, each panel in separate sash with two sashes movable on a vertical plane. Double hung windows typically have a first sash and a second sash. Each sash has a top stile and a bottom stile and a pair of opposed sides. The sides of the sashes are positioned in a track in the assembly. Each assembly may have two tracks, one track for each sash. One sash is a lower sash and the second sash is the upper. Each sash is capable of moving vertically in its respective channel or a track that is positioned on opposite sides of each sash. The sash may be raised and lowered in the channel as needed by the user for ventilation.

Numerous latches for double hung windows are known. Many such latches typically include a catch portion, which is secured to a lower window sash, and a keeper portion, which is secured to an upper window sash. The catch portion is moved into engagement with the keeper portion to latch the sashes against movement relative to one another (the locked position), and the catch portion is moved clear of the keeper and the upper window sash (the unlocked position) to allow movement of the sashes relative to one another.

One of the issues with double hung windows is security. Because the windows are raised and lowered on numerous occasions, there is a need to prevent unauthorized movement of the sash by an intruder and others attempting unauthorized entry. As a result, many double hung windows have sash locks present. The sash lock has generally two separate members. The first is the lock mechanism itself which, in many instances, is made up of a base with a locking member that moves from an engaged position to a disengaged position. The lock mechanism is usually secured to the upper stile of upper member of the window sash. The second member of a sash lock is the keeper. The keeper is typically secured to the upper portion of the lower stile of the window sash.

When the window is to be locked, the locking member engages the keeper so that at least a portion of the lock member extending from the lock mechanism is secured by the keeper. A problem with this type of lock is that there is no readily visible means for alerting the user that the latch is in the locked or unlocked position. The failure to readily determine whether the sash lock is in a locked position creates a security risk in that the homeowner or others may fail to lock the window and thus leave the premises open to intruders. There is a security issue with traditional sash locks in that they require the homeowner to visually check each lock while being in close proximity to the lock in order to ascertain if the sash lock is in a locked arrangement with the keeper. Since many homes have ten to twenty windows or more, this was a time consuming process and cause for aggravation when the homeowner is in a rush to leave for an appointment. As a result, there is a need for a sash lock that permits a user to readily determine if a sash lock is in locking engagement. The present invention solves this problem by providing an indicator on the latching mechanism that will automatically indicate or signal the status of the latches. Thereby, people in a rush, or young children, or persons with memory deficiencies will be able to easily, readily, visually, or even by tactile means to know if the latch mechanism is in a locked/unlocked status.

SUMMARY OF THE INVENTION

The present invention relates to a signaling device that indicates the locked/unlocked status of objects that are latched against movement relative to one another; and in a preferred application, to a latch for a double hung window. The present invention can also relate to other types of windows and doors which are retained in position by the combination of a locking mechanism such as a catch and a keeper. The indicator of the present invention includes any type of indicator, flag, signal, or other indicia whether visual, aural, or tactile. The indicator may have two basic positions: locked position and non-locked position. Thus, there can be a visual signal corresponding, respectively, to a locked status and unlocked status of the locking arrangement. The indicator is moved into its respective status by the movement of the locking structure engaging the indicator. In an alternative embodiment, the visual reference can signal an unlocked status and the non visual a locked status of the window.

In a first aspect of the present invention there is provided an improved sash lock that provides a visual signal when the sash lock actuator is in locking engagement with the respective keeper. This visual signal may be in the form of a flag, a raised member or other visual or other signal that has a first or non locking position such that the flag extends from the keeper and provides a clear indicator of the status of the unlocked arrangement and a second retracted position when the sash lock actuator is in a locked position.

In another embodiment of the present invention, the actuator on the sash lock assembly contacts a member in the base of the keeper as the actuator is locked causing a flag to rise signaling that the actuator is secured to the keeper and that the window is locked.

Any suitable signal means may be used in the present invention. In the preferred embodiment the signal means may be a flag but it will be appreciated that other signal means may be used. For example, there may be a pair of indicators on the keeper and a sliding door that travels in response to the movement of the actuator to cause one of the indicators to be covered when the actuator and the keeper are in a locked position. When the actuator travels to an unlocked position, the sliding door can travel such that the first indicator is covered and the second indicator is revealed. In one embodiment, the flag can be a flat member that extends upwardly from the keeper body. In another embodiment the flag may be a protrusion of any shape that extends from the keeper but provides an indication of the status.

OBJECTS OF THE INVENTION

It is an object of the present invention to provide an improved sash lock.

It is another object of the invention to provide a sash lock and keeper that increases window security.

It is also an object of the present invention to provide a sash lock that has a means for readily determining whether window sashes are locked by the sash lock and the keeper.

It is still another object of the invention to provide a sash lock assembly having an improved keeper for providing a visual indication whether a sash window is locked.

It is a further object of the invention to provide a keeper for a sash lock assembly that has a signal flag for showing whether a sash window is locked.

It is a still further object of the invention to provide a keeper having a flag for signaling whether the keeper is locked to the remainder of the sash lock assembly.

It is still another object of the present invention to provide a simple, effective and practical device for positively monitoring the status or condition of a locking arrangement for a sash lock.

It is a still further object of the present invention to provide an inexpensively manufactured and easily installed sash lock that operates on existing, conventional locking arrangements.

BRIEF DESCRIPTION OF THE DRAWINGS

FIG. 8 is a perspective view of a keeper made in accordance with the present invention.

FIG. 9 is the keeper of FIG. 8 with the flag separated from the body of the keeper.

FIG. 10A is a side view of the keeper of FIG. 8.

FIG. 10B is a top view of the keeper of FIG. 8.

FIG. 10C is a cut away view of FIG. 10A taken along A-A.

FIG. 11 is a cut away view of the keeper of FIG. 8.

FIG. 12 is a perspective view of the keeper of FIG. 8 with the flag raised.

FIG. 13 is an end view of the keeper and sash lock.

FIG. 14 is a view of the combination sash lock and keeper in a locked arrangement with the signal flag raised.

FIG. 15 is a view of the combination sash lock and keeper in an unlocked arrangement with the keeper lowered.

FIG. 16A is a cut away side view of the keeper of FIG. 14.

FIG. 16B is a top view of the keeper and sash lock of FIG. 14 with the flag raised to indicate a locked arrangement.

FIG. 16C is a cut away view of the keeper and sash lock of FIG. 16B taken along B-B.

FIG. 17 is a view of the underside of the lock and keeper of FIG. 14.

DETAILED DESCRIPTION OF THE INVENTION

Figure 1:
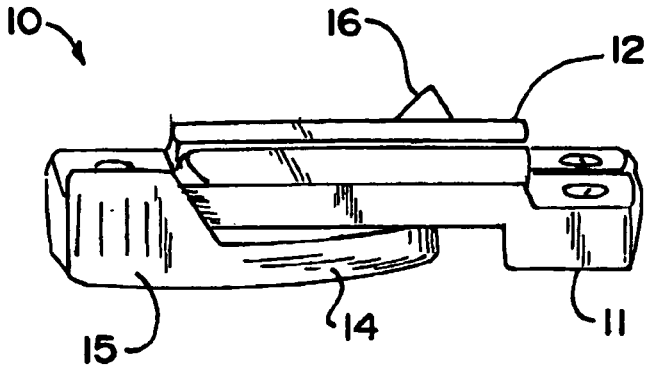
FIG. 1 is a view of one embodiment of a sash lock assembly of the present invention in a locked configuration.

While this invention is susceptible of embodiment in many different forms, there is shown in the drawing and will herein be described in detail preferred embodiments of the invention with the understanding that the present disclosure is to be considered as an exemplification of the principles of the invention and is not intended to limit the broad aspect of the invention.

The sash window assembly on which the present invention may be used may include an upper sash window and a lower sash window. Each of the sash windows may be mounted within opposed guide rails on a frame. At least one of the sash windows is slidable within the frame relative to the other sash window. The present invention may also be used in a single sash window that is hinged on one end and lockable on the opposite end. These windows typically open inwardly or outwardly and can be held in place by a chain or other means when opened.

As seen in FIGS. 1-4 there is a sash lock 10 having a locking assembly 11 and a keeper 12. The sash lock may be any suitable shape desired. The locking assembly 11 has a body 13 with an actuator arm 14 secured to the catch 18. Alternatively, the arm 14 may be pivot a cam to which the catch is connected. The catch may be any suitable securing means such as a magnet or hook that secures the sash locking assembly to the keeper. The actuator arm 14 preferably includes a handle 15 or a driving or gripping portion that permits the user to readily move the catch 18 into a locked position by engaging the keeper 12. In a typical assembly, the catch has a hook shaped portion (see 59 of FIG. 16B) that engages member 53 on the keeper and retains the keeper in a locking position. When the catch moves into this locked position it preferably automatically engages the signaling device 16 causing it to move to a signaling position. The signaling device which may be a flag or pennant or other suitable signaling means. The signaling device may be rotatable from a first position to a second position by the action of the catch. One of these positions may signal a locking relation and the other position, an unlocked relation. The signaling means may, for example, be axially pinned 17 to the keeper structure and rotates to a visible status. Alternatively, the signal means be sensed by sound or by a touchable signal.

The size and materials of construction of the signaling device or indicator is determined by the size and style of the latching mechanism. It can be appreciated that the indicator can work in a reversed mode; that is visible or tactilely engageable when the latching mechanism is open and non-visible or non tactilely engageable when the latching mechanism is locked. To accomplish the latter mode, the signaling device or indicator may, for example, be spring-biased such that when the catch is not present, the spring forces the flag into an upright or raised position. When the catch is present, the catch hits the bottom portion of the rotating or pivoting flag member it forces the flag into a retracted position.

Figure 2:
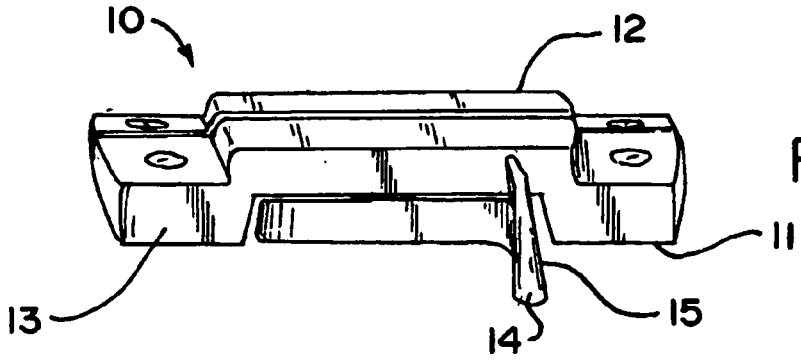
FIG. 2 shows the sash lock assembly of FIG. 1 with a signaling means indicating that the keeper and the sash lock are in an unlocked arrangement.
Figure 3:
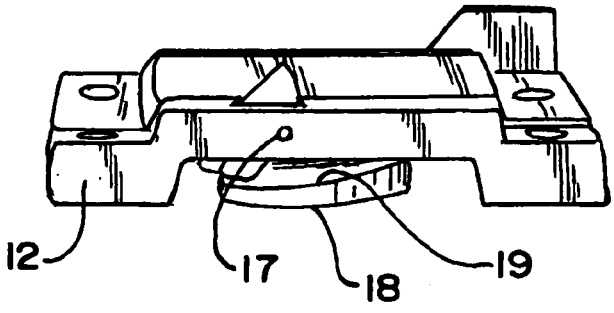
FIG. 3 shows a rear view of the sash lock assembly of FIG. 1 with the actuator of the lock contacting the signal means of the keeper.
Figure 4:
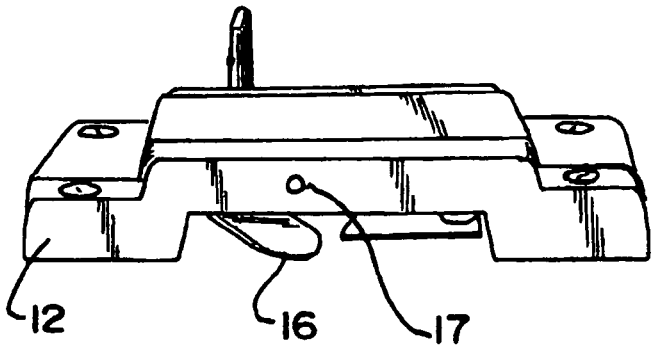
FIG. 4 shows the rear view of the sash lock assembly of FIG. 3 with the actuator of the lock and the keeper in a non-locking configuration.

The locking assembly 11 is secured to a surface on the stile of a sash. The actuator arm 14 has typically two positions. The first is a locked position as seen in FIG. 1. When the arm is moved to the locking position as seen in FIGS. 1 and 3, the actuator mechanism causes a signal means to reflect the locking arrangement. In the example of FIGS. 2 and 4, there is a flag which has retracted into the keeper to signal an unlocked relationship. FIG. 3 shows the catch 18 that the actuator arm 14 operates. In this embodiment the catch is a sloped member that is moved by the actuator arm. The catch can perform two functions in the present invention. The first is to secure the locking assembly to the keeper to prevent the window sash from opening. The second is that it can activate the signal means to indicate whether the window is locked or unlocked. In the FIGS. 1-4, the arm 14 turns the catch 18, the sloped surface 19 of the catch forces the signal means into position to show a locking relationship. Alternatively, the catch may extend from a cam that is rotated by the actuator arm and an actuating portion of the cam contacts the signal means causing it to indicate the relationship between the keeper and the locking assembly.

The signal means may be a small flat sheet of material that pivots about a pin. As the sloped portion of the actuator means 18 pushes against the bottom surface of the signal member, the flag is caused to rise through a slot in the upper surface of the keeper signaling a locked relationship. As the actuator arm is pushed in the opposite direction, the sloped portion of the actuator means 18 causes the flag to be lowered to signal that the keeper and sash lock are in an unlocked arrangement.

It will be appreciated by those skilled in the art that there may be a variety of actuator means that can be used to cause a signal means to be raised and lowered as the sash lock and keeper go from a locked to an unlocked relationship.

Figure 5:
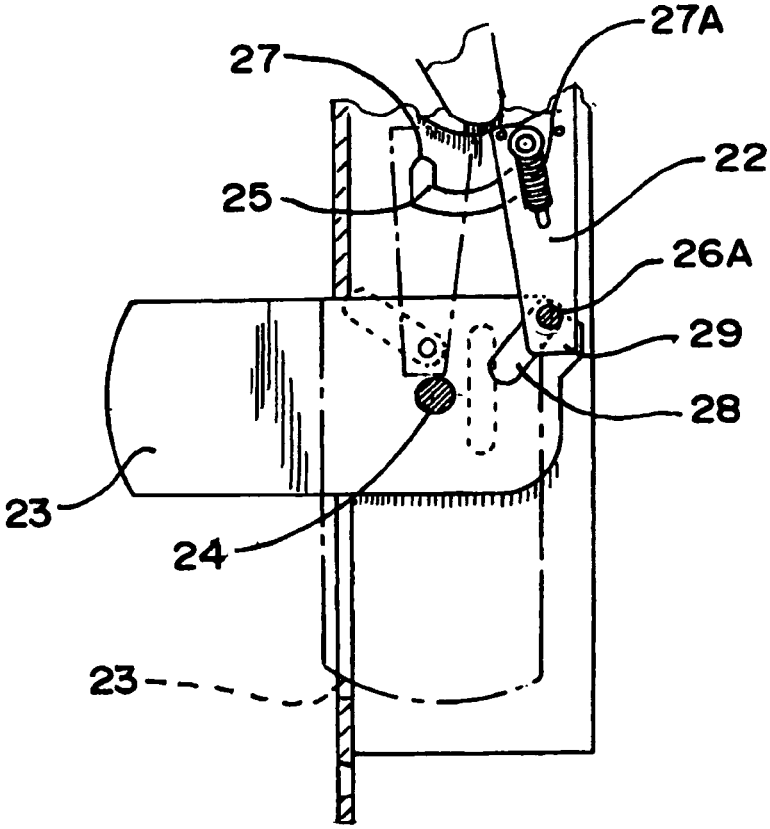
FIG. 5 is an alternative embodiment of a signal or indicator mechanism of the present invention.

As seen in FIG. 5, the indicator mechanism has a spring biased member 22 movable from a first position 27 to a second position 27A in a slot 25 at one end of the spring biased member. The slot is preferably generally "C" shaped as shown in FIG. 5. At the other end 29, the spring biased member 22 is attached to the indicator 23 by means of pivot pin 26A. The indicator 23 moves between a locked, visible position (solid lines) to an unlocked, non-visible position (dotted lines) as the spring based member is moved by the motion of the catch. The indicator rotates about axis 24. As a portion of the catch contacts the spring biased member, the spring biased member moves in the slot 25 from one position to the other. When the pressure of the catch is, released the spring biased member reverts to its initial position. Either the first position or the second position of the spring biased member can be the locked position as desired.

Figure 6:
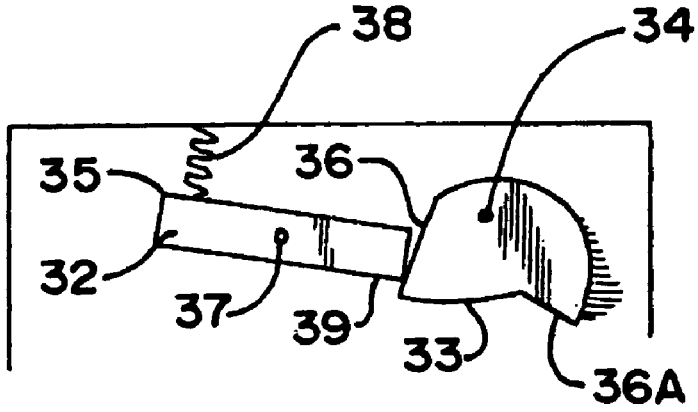
FIG. 6 is another embodiment of a signal or indicator mechanism of the present invention.

In FIG. 6, the indicator mechanism has spring-biased member 32. At one end 35 of member 32 there is a spring 38 secured to the member 32 and the body of the keeper. The member 32 rotates or pivots about axis 37 into and out of contract with the cam-shaped member 33. The cam shaped member pivots about pin 34 from a locked position to an unlocked position and causes the indicator to be raised and lowered in the keeper. The cam shaped member 33 pivots about axis 34 due to movement of the catch. The cam shaped member may have a first engaging section 36 or a second engaging section 36A. As the cam member 33 rotates the engaging section 36 or 36A. contacts member 32 at end 39 causing the member 32 to pivot into a position in which end 39 is raised above the surface of the keeper and acts as a signal. When the cam member releases its contact with member 32 the spring forces the end 39 to retract into the body of the keeper.

Figure 7:
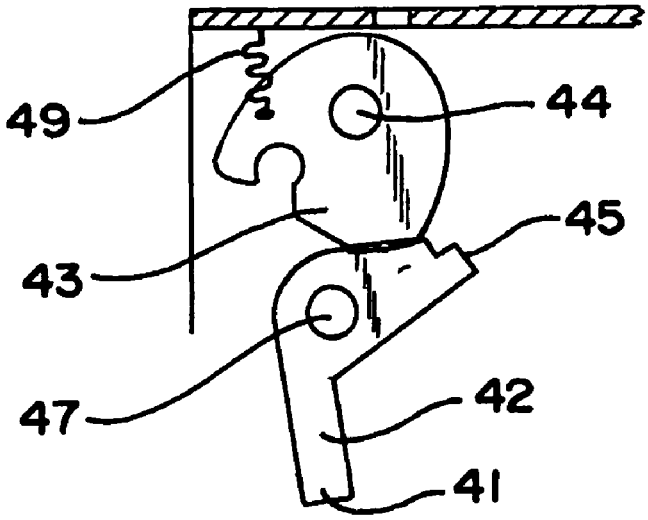
FIG. 7 is still another embodiment of a signal or indicator mechanism of the present invention.

In FIG. 7, the indicator mechanism contacts a generally L-shaped member 42 that rotates about axis 47. As the L-shaped member rotates, it enters into contact with and out of contact with cam shaped member 43 that rotates about axis 44. The cam shaped member is spring-biased by spring 49. The L-shaped member 42 has a first end 41 and a second end 45. As the cam member 43 pivots it forces the L shaped member 42 to pivot from a first position to a second position that causes the first end of the L-shaped member to extend above the surface of the keeper so that it signals that the catch and keeper are in a locked relationship. Alternatively, the device can be arranged so that the positions are reversed so that as the cam member 43 pivots the first end of the L-shaped member extends above the surface of the keeper and signals an unlocked position instead of a locked position.

FIGS. 8-18 show another embodiment of the sash lock of the present invention. The sash lock includes a lock assembly and a keeper. As seen in FIGS. 16 and 17. There is a locking assembly 51 and a keeper 52. The keeper 52 includes a keeper surface 53 that the catch in the locking assembly secures the locking assembly to the keeper. The keeper preferably has a pair of orifices 61 and 62, one at each end of the keeper body 63. The orifices can be used to secure the keeper to the surface of a sash by means of a screw or other suitable means. The keeper body 63 is provided with a slot 64. The slot is shaped to reflect the size and shape of the indicator 65 which indicates whether the keeper 52 and locking assembly 51 are in a locking arrangement. As seen in FIG. 9, the keeper is provided with an indicator assembly 66 which has an arm 67. One end of the arm 67 is secured to the underside of the keeper 52. The other end of the arm is provided with an indicator 65. The indicator may be a flag or other type of signal means for indicating whether the sash lock assembly 51 is secured to the keeper. The arm 67 may slightly bent downwardly so that it requires a force from the catch means in the lock assembly to push the indicator upwardly through the slot. This catch means may be a cam that is rotatable or pivots on the lock assembly 51. As the catch rotates to secure the keeper, it contacts the underside of the arm 67 and forces the flag 65 through the slot 68. This signals that the window is locked. As the catch releases the keeper, the arm is permitted to retract from the slot thereby signaling that the keeper and the sash lock are in an unlocked relation.

The sash lock also includes locking assembly 51 for mounting on an adjacent style of the lower sash window. The locking assembly 51 may include a housing 55 having an orifice 56, an actuator arm 57 and a cam 58. The cam 58 has a cam surface 59 for engaging the keeper surface 53. The locking assembly also includes a shaft 60 extending through the orifice 56 and operably coupling the actuator arm to the cam.

The keeper and the locker assembly may be made from any suitable material such as metal or plastic. A preferred plastic is a glass filled polypropylene, glass filled nylon or a blend of glass filled polypropylene and nylon. If made of metal, a preferred metal is zinc.

The actuator arm and the shaft are preferably a unitary member. The shaft and the cam may have cooperatively mating faces for rotatably securing the shaft to the cam. The shaft and the orifice have corresponding circumferential surfaces. The shaft has a shaft projection extending from its circumferential surface. The hole has two spaced hole projections extending from its circumferential surface. The shaft projection engages one or the other of the hold projections to limit rotational travel of the actuator arm and thereby define locked and unlocked position respectively.

The shaft may have a threaded screw receiving hole to receive a metal screw (not shown) to secure the cam to the shaft.

The housing has a pair of holes for receiving screws to secure the housing to its style. The keeper has a pair of keeper holes for receiving screws to secure the keeper tot he style.

We claim:

1. A sash lock for a sash window assembly, the sash window assembly including an upper sash window and a lower sash window, each of the sash windows being mounted within opposed guide rails on a master frame wherein at least one of the sash windows is slidable within the frame relative to the other sash window, a sash lock comprising a locking assembly for mounting on a stile of one of the sash windows and a keeper for mounting on a stile of the other sash window, the locking assembly comprising a housing, an actuator for moving a catch, said catch pivotally connected to said housing and engages and disengages said keeper as said catch is moved from a first position to a second position, said keeper having a top surface, a bottom surface and at least one sidewall which is secured to said second sash window, said top surface having a slot extending through said top surface, said keeper having an indicator pivotally attached to said sidewall of said keeper, said catch contacting a side surface of said indicator during the movement of said catch from said first position to said second position causing said indicator when in a retracted position within said keeper to pivot and a portion thereof to pass through said slot in said top surface of said keeper and extend outwardly of said keeper, and signal whether the locking assembly is in locking engagement with said keeper, said indicator pivoting and retracting into said orifice in said keeper when said catch is moved from said second position to said first position.

2. The sash lock according to claim 1 wherein the indicator is rotatable from a first position to a second position by the action of a cam in said locking assembly.

3. The sash lock according to claim 2 wherein the catch has a sloped surface and wherein movement of the sloped surface of the catch forces the indicator into a position wherein said indicator extends outwardly from said keeper.

4. The sash lock according to claim 3 wherein the sloped portion of the catch pushes against a side surface of the indicator, causing the indicator to rise through said slot in said top surface of the keeper.

5. The sash lock according to claim 4 wherein the indicator extending through said top surface of the keeper indicates that the locking assembly and the keeper are in locked arrangement.

6. The sash lock according to claim 1 wherein the indicator is moved from a first position to a second position by a spring biased member that is movable from a first position to a second position by a cam.

7. The sash lock according to claim 6 wherein the spring biased member travels in a "C" shaped slot.

8. The sash lock according to claim 7 wherein the indicator rotates about an axis and as a portion of the cam contacts the spring biased member, the spring biased member moves in the slot from said first position to said second position and when the pressure of the cam is released from the spring biased member the spring biased member reverts to its first position.

9. The sash lock according to claim 1 wherein a spring-biased member has a first end and a second end and wherein at said first end there is a spring secured to the member and the keeper, said spring biased member being adapted to pivot about an axis such that a second end of said spring biased member enters into and out of contract with a cam-shaped member, said cam shaped member being adapted to pivot from a first position to a second position and adapted to cause the indicator to be raised and lowered in the keeper due to movement of a cam shaped member.

10. The sash lock according to claim 9 wherein as the cam shaped member releases its contact with said spring biased member the spring forces the indicator to retract into the keeper.

11. The sash lock according to claim 1 wherein a cam shaped member rotates about axis when said actuator is moved, said cam shaped member having a portion thereof which contacts one end of a generally L-shaped member that pivots about an axis, as the L-shaped member pivots, a second end of said L shaped member extends above the surface of said keeper.

12. The sash lock according to claim 1 wherein a cam shaped member rotates about axis when an actuator is moved, said cam shaped member having a portion thereof which contacts one end of a generally L-shaped member that pivots about an axis, as the L-shaped member pivots, a second end of said L shaped member contacts an indicator such that as the cam member pivots it forces the L shaped member to pivot from a first position to a second position causing an end of the L-shaped member to contact an indicator causing the indicator to extend above the surface of the keeper so that it signals that the relationship of the locking assembly and the keeper.

13. The sash lock according to claim 12 wherein the position of the indicator extending above the surface of the keeper signals that the locking assembly and the keeper are in a locked relationship.

14. The sash lock according to claim 1 wherein the keeper has an indicator assembly comprising an arm, a first end of the arm being secured to said keeper and the second end of the arm being provided with an indicator and wherein a force from the catch in the lock assembly pushes the indicator upwardly through a slot in said keeper.

15. The sash lock according to claim 14 wherein as the catch pivots it contacts an underside of the arm and forces the indicator through the slot.

* * * * *